US005887361A

United States Patent [19]

Cabanis et al.

[11] Patent Number: 5,887,361

[45] Date of Patent: Mar. 30, 1999

[54] SPORTS BOOT WITH A MOBILE COLLAR

[75] Inventors: Louis Cabanis, Rumilly; Jean-Louis DeMarchi, Saint-Jorioz, both of France

[73] Assignee: Salomon S.A., Metz-Tessy, France

[21] Appl. No.: 960,319

[22] Filed: Oct. 29, 1997

[30] Foreign Application Priority Data

Nov. 8, 1996 [FR] France ..... 96 13852

[51] Int. Cl.[6] ..... A43B 5/00

[52] U.S. Cl. ..... 36/115; 36/117.1; 36/117.6

[58] Field of Search ..... 36/55, 10, 93, 36/117.6, 115, 118.2, 117.1

[56] References Cited

U.S. PATENT DOCUMENTS

| | | | |
|---|---|---|---|
| 3,494,054 | 2/1970 | Lange | 36/2.5 |
| 5,046,746 | 9/1991 | Gierveld | 280/11.22 |
| 5,177,884 | 1/1993 | Rullier | 36/117 |
| 5,228,218 | 7/1993 | Bonnaventure | 36/55 |
| 5,279,053 | 1/1994 | Pallatin et al. | 36/10 |
| 5,337,493 | 8/1994 | Hill | 36/55 |
| 5,386,649 | 2/1995 | Paris | 36/10 |
| 5,437,466 | 8/1995 | Meibock et al. | 280/11.22 |
| 5,566,475 | 10/1996 | Donnadieu | 36/55 |

FOREIGN PATENT DOCUMENTS

| | | |
|---|---|---|
| 0416437 | 3/1991 | European Pat. Off. . |
| 0651953 | 5/1995 | European Pat. Off. . |
| 0723744 | 7/1996 | European Pat. Off. . |
| 2668072 | 4/1992 | France . |
| 3043425 | 7/1982 | Germany . |
| 9000384 | 9/1990 | Netherlands . |

*Primary Examiner*—M. D. Patterson
*Attorney, Agent, or Firm*—Greenblum & Bernstein P.L.C.

[57] ABSTRACT

A boot of the type that includes a low upper equipped with a rigid heel reinforcement and a rigid collar journalled on the reinforcement of the upper, in the area of the upper end thereof, the collar being equipped internally with a lining. The lining has an extension, extending downwardly within the upper up to the level of the base thereof. Advantageously, the extension is detachably connected to the upper and it is at least partially elastic.

27 Claims, 2 Drawing Sheets

3c
3a
6
14
3
13
14c
14b
14a
11
4
12
4
2a
2
1

SPORTS BOOT WITH A MOBILE COLLAR

BACKGROUND OF THE INVENTION

1. Field of the Invention

The instant invention is related to a sports boot that is specifically intended for sports that require both a substantial longitudinal mobility for the foot with respect to the leg for the extension/bending movements thereof, as well as a good ankle retention in order to resist the transverse forces that are generated by actions such as edge setting, walking over uneven terrain, etc.

Included in such sports, in a non-limiting manner, are certain sports known as glide sports, such as cross-country skiing, ice skating, roller skating etc. as well as other sports, such as walking, hiking over hilly terrain etc.

2. Description of Background and Relevant Information

European Patent Application No. 0 416 437 discloses a boot of the aforementioned type, having a low upper construction with a stiff collar being journalled on a rear rigid spoiler of the upper, in the area of the upper end thereof.

Such a construction wherein the collar pivots in a totally free manner towards the front and towards the rear provides complete satisfaction as regards the desired mobility of the foot/leg and the transverse retention of the ankle.

However, the absence of any connection between the upper and the collar can cause certain problems of imperviousness, as well as problems related to the introduction of the foot in the boot.

SUMMARY OF THE INVENTION

It is an object of the instant invention to provide a boot construction of the above-mentioned type that resolves the problems mentioned above, while retaining its characteristics of longitudinal mobility and transverse stability.

This goal is achieved in the boot according to the invention which is of the above-mentioned type, i.e., including a low upper equipped with a rigid rear spoiler and a stiff collar journalled on the rear spoiler of the upper at the level of the upper end thereof, the collar being equipped internally with a lining that is affixed thereto, wherein the lining has a downward extension, extending within the upper up to the level of the base thereof.

Specifically, the downward extension of the lining enables the desired continuity between the collar and the upper to be obtained, thus making it easy to introduce the foot within the boot.

Advantageously, the extension is equipped with a connection at the base of the upper and is at least partially elastic. Thus, the lining remains in place within the upper, even when the foot is removed, without in any way hampering the extension/bending movements of the leg, by virtue of the elasticity of the lining.

BRIEF DESCRIPTION OF THE DRAWINGS

The invention will be better understood and other characteristics thereof will become more apparent from the description that follows with reference to the annexed schematic drawings that illustrate and represent, in a non-limiting manner, a preferred embodiment of the invention, wherein.

DETAILED DESCRIPTION OF THE PREFERRED EMBODIMENTS

Figure 1:
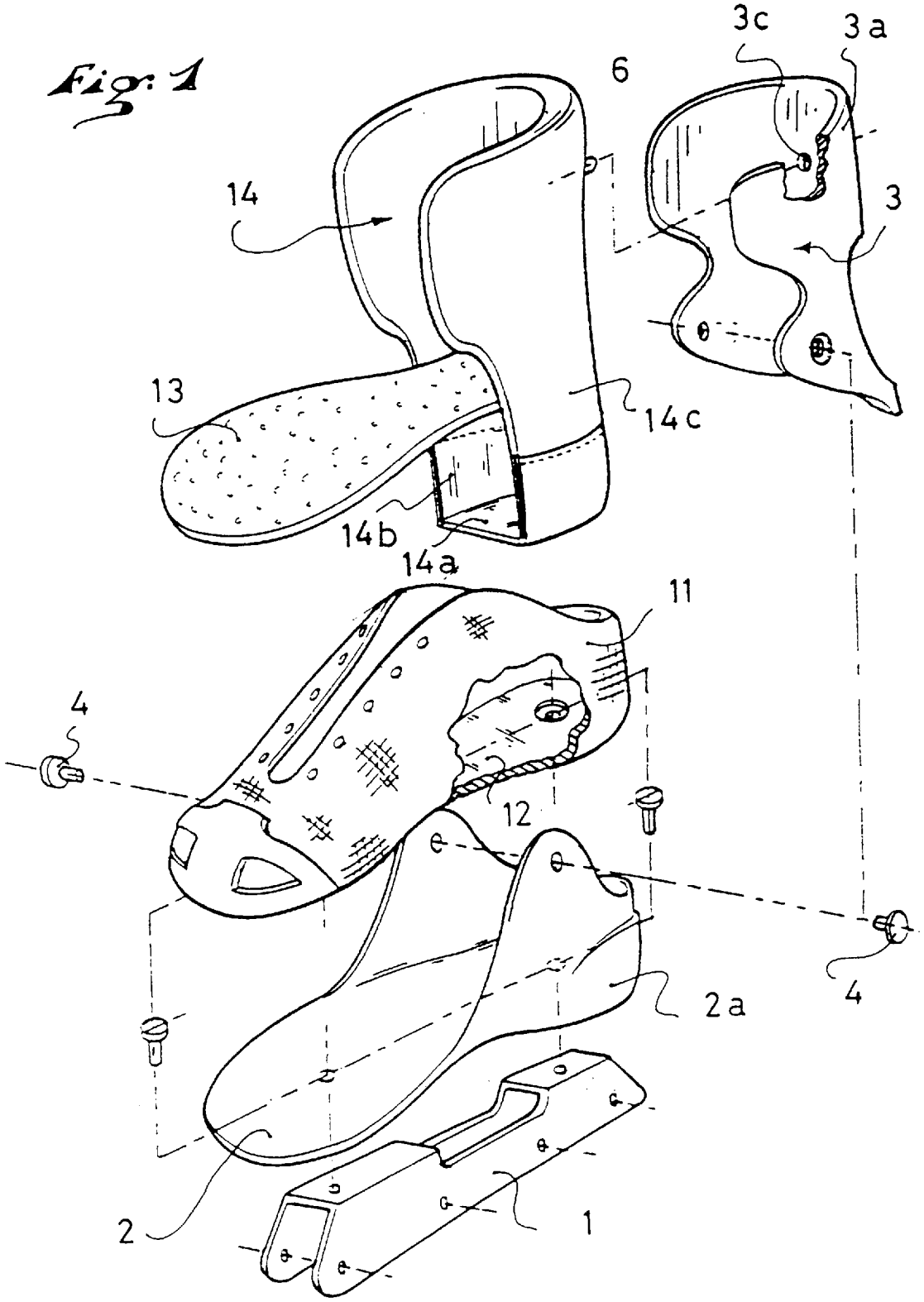
FIG. 1 is an exploded perspective view of a boot according to the invention as applied to a roller skate.
Figure 3:
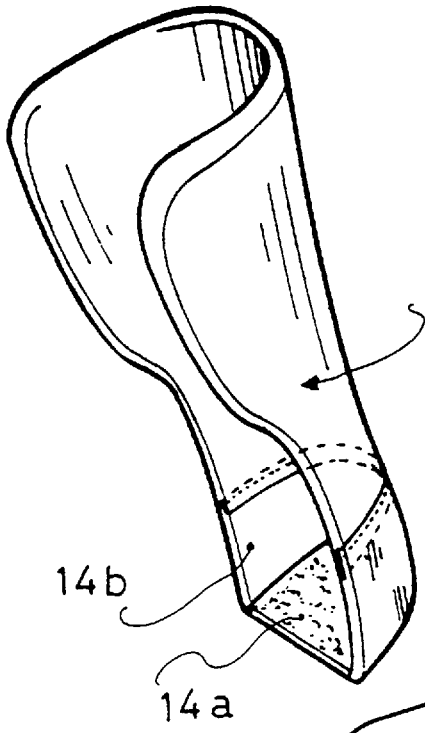
FIG. 3 is a perspective view of the collar lining.
Figure 2:
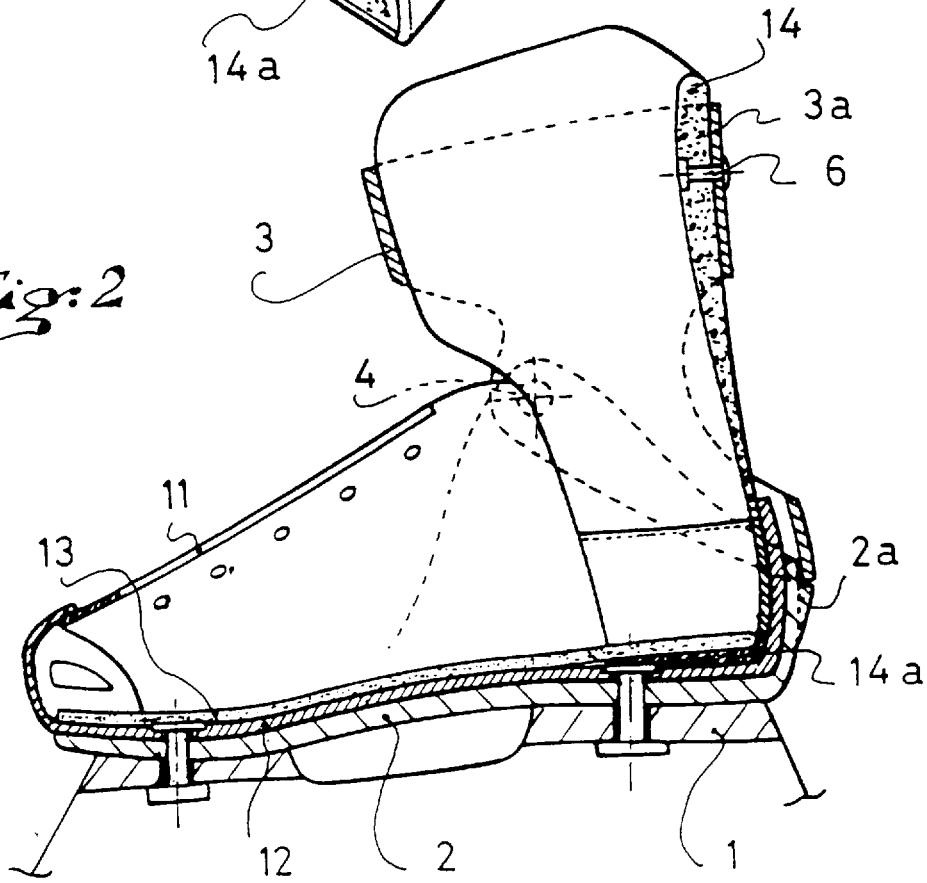
FIG. 2 is a longitudinal sectional view of the boot of FIG. 1.

FIGS. 1 through 3 show a non-limiting application of a boot construction according to the invention as applied to a boot of the in-line roller skate type.

The skate includes:

- a chassis 1 adapted to receive the wheels, not represented in the drawing;
- a rigid boot frame including:
  - a rigid base 2 that defines both the sole portion of the boot that is intended to be connected to chassis 1, as well as a heel reinforcement 2*a* originating from the base 2;
  - a rigid collar 3 mounted in a journal at the upper end of the reinforcement 2*a* via two lateral connection elements 4 defining a transverse journal axis, located substantially in the area of the malleoli; and
- a flexible boot portion including:
  - a low upper 11 or, in other words, an upper that does not extend upwards beyond the heel reinforcement 2*a* and equipped with a base (or assembly sole) 12;
  - an inner detachable sole 13;
  - a collar lining 14.

A closure device of any known type, although not represented in the drawings, is provided on upper 11 and collar 3 so that they are tightened on the user's foot and ankle.

As has been represented more specifically in FIGS. 2 and 3, the collar lining 14 has a substantially tubular shape, i.e., a semi-cylindrical shape, open towards the front and extending from the base 12 of the low upper 11 up to the upper end 3*a* of the collar, and even beyond such collar.

This lining 14 is closed at its lower end by a base 14*a* adapted to be positioned beneath the inner sole (also known as the insole) 13. The cooperation of the base 14*a* with the inner sole 13 enables a certain connection or anchoring to be obtained between the lining 14 and the upper 11, such anchoring being adequate for the introduction of the foot in the boot. The base 14*a* is connected to the upper portion 14*c* of the lining via a portion 14*b* made of a material that is stretchable in a vertical direction or, in other words, in the longitudinal direction of the lining 14.

The upper portion 14*c,* which is made of a foam type material, and covers the entire inside of the rigid collar 3 so that it is comfortable, is affixed to the latter in a detachable manner by a button or projecting pin 6 or similar element, cooperating with a hole 3*c* of the collar. Other detachable connection means could naturally also be provided.

In view of the fact that the connection of collar 3 with lining 14 is detachable, the lining can be removed and changed in case of wear and tear, or to provide a better fit for the user's leg.

Such lining 14 can also be removed so as to facilitate its drying, as needed.

As it is easy to envision, the construction of lining 14, according to the invention, with the extensions 14*b,* 14*a* extending towards the base 12 of the upper, allows the continuity of the lining to be ensured between the collar 3 and upper 11, and thus facilitates the feeding operation while avoiding any inward reversals of the top parts of upper 11.

Moreover, its connection with base 12 of the upper by means of the inner sole 13 does not hamper the frontward and rearward bending movements of the collar 3 since the elastic portion 14*b* is designed to accompany these bending/extending movements. It ought to be noted that other connections, such as for example, a connection of the self-gripping type, such as the so-called hook and loop type, can also be provided to ensure the detachable connection of the lining 14 with the inside of upper 11 or its base 12, as long as such means do not hinder the elastic deformation capacity of the lining 14 in the vertical direction.

The structure of lining 14, open towards the front, also guarantees that the user will encounter no discomfort in the area of the bending fold during a frontward bending because folds are not formed at all.

The instant invention is not to be limited to a boot for a roller skate, but can also find an application in other sports boots that must fulfill similar or identical requirements.

The instant application is based upon the French priority patent application No. 96.13852 filed on Nov. 8, 1996, the disclosure of which is hereby expressly incorporated by reference thereto, and the priority of which is hereby claimed under 35 USC 119.

What is claimed is:

1. A boot comprising:

a rigid boot portion having:

a rigid base comprising a sole portion, a heel reinforcement, and side portions; and a rigid collar for providing ankle support, the rigid collar being journalled to the side portions of the rigid base;

a flexible boot portion having a low upper which terminates below a top edge of said collar;

wherein the flexible boot further comprises a lining adapted to provide internal protection for said rigid collar, said lining extending downwardly from an upper part of the rigid collar to the level of the sole portion of the rigid base.

2. A boot as defined by claim 1, wherein the lining comprises an elastic portion made of a stretchable material, stretchable at least in a vertical direction, the lining having means for removable attachment to the rigid base.

3. A boot as defined by claim 1, wherein the lining of the flexible boot includes a base part, the flexible boot portion further comprising an insole arranged within the boot so that the base part of the lining is beneath the insole of the flexible boot.

4. A boot as defined by claim 1, wherein the lining of the flexible boot includes a base part attached to the upper by a complementary self-gripping connection.

5. A boot as defined by claim 1, wherein a means for detachably connecting connects the lining to the collar.

6. A boot as defined by claim 5, wherein the means for detachably connecting includes a projecting pin passing through a hole of the collar.

7. A boot as defined by claim 1, wherein the lining has a tubular, semi-cylindrical shape, open toward the front.

8. A boot as defined by claim 1, wherein the collar is mounted at an upper end of the side portions of the rigid base via two lateral connections located substantially in the area of the malleoli.

9. A boot as defined by claim 1, wherein the boot is a skate boot, a skate chassis being connected to the sole portion of the rigid base.

10. A boot comprising:

a rigid boot portion having:

a rigid base portion having a sole portion, a heel reinforcement and side portions extending laterally from said sole portion; and a rigid collar journalled to the side portions of the rigid base portion adapted to provide a rigid ankle side support;

a soft boot portion having:

an upper attached to said rigid base, said upper extending below an upper end of the collar; and a separate collar lining arranged to extend upwardly beyond the collar upper end and downwardly to the level of the sole portion of the rigid base.

11. A boot as defined by claim 10, wherein the collar lining comprises an elastic portion made of a stretchable material, stretchable at least in a vertical direction, the lining being removably attached to the rigid base.

12. A boot as defined by claim 10, wherein the collar lining includes a base part, the soft boot portion further comprising an insole arranged within the boot so that the base part of the lining is beneath the insole of the soft boot.

13. A boot as defined by claim 10, wherein the collar lining of the soft boot includes a base part attached to the upper by a complementary self-gripping connection.

14. A boot as defined by claim 10, wherein a means for detachably connecting connects the collar lining to the collar.

15. A boot as defined by claim 14, wherein the means for detachably connecting includes a projecting pin passing through a hole of the collar.

16. A boot as defined by claim 10, wherein the collar lining has a tubular, semi-cylindrical shape, open toward the front.

17. A boot as defined by claim 10, wherein the collar is mounted at an upper end of the side portions of the rigid base via two lateral connections located substantially in the area of the malleoli.

18. A boot as defined by claim 10, wherein the boot is a skate boot, a skate chassis being connected to the sole portion of the rigid base.

19. A boot comprising:

a rigid boot portion having:

a rigid base portion having a sole portion and a heel reinforcement; and a rigid collar journalled to the rigid base so as to provide a rigid ankle lateral support;

a soft boot portion having:

an upper extending longitudinally from a toe to a heel of the boot and surrounding the foot of a user and extending vertically to a level located below an upper end of the collar; and a collar lining arranged vertically to extend from substantially a level of the sole in a heel region to the upper end of the collar, said collar lining being arranged longitudinally to end at a level proximate the heel region of the boot.

20. A boot as defined by claim 19, wherein the collar lining comprises an elastic portion made of a stretchable material, stretchable at least in a vertical direction, the lining being removably attached to the rigid base.

21. A boot as defined by claim 19, wherein the collar lining includes a base part, the soft boot portion further comprising an insole arranged within the boot so that the base part of the lining is beneath the insole of the soft boot.

22. A boot as defined by claim 19, wherein the collar lining of the soft boot includes a base part attached to the upper by a complementary self-gripping connection.

23. A boot as defined by claim 19, wherein a means for detachably connecting connects the collar lining to the collar.

24. A boot as defined by claim 23, wherein the detachable connection is a projecting pin passing through a hole of the collar.

25. A boot as defined by claim 19, wherein the collar lining has a tubular, semi-cylindrical shape, open toward the front.

26. A boot as defined by claim 19, wherein the collar is mounted at an upper end of the side portions of the rigid base via two lateral connections located substantially in the area of the malleoli.

27. A boot as defined by claim 19, wherein the boot is a skate boot, a skate chassis being connected to the sole portion of the rigid base.

* * * * *